US005576162A

United States Patent [19]

Papadopoulos

[11] Patent Number: 5,576,162

[45] Date of Patent: Nov. 19, 1996

[54] IMAGING ELEMENT HAVING AN ELECTRICALLY-CONDUCTIVE LAYER

[75] Inventor: Kimon Papadopoulos, Penfield, N.Y.

[73] Assignee: Eastman Kodak Company, Rochester, N.Y.

[21] Appl. No.: 588,180

[22] Filed: Jan. 18, 1996

[51] Int. Cl.[6] ..... G03C 1/85

[52] U.S. Cl. ..... 430/527; 430/523; 430/538; 430/631; 430/502; 430/616; 430/495.1; 430/31; 430/56; 430/202; 430/270.1

[58] Field of Search ..... 430/502, 495, 430/523, 527, 631, 538, 31, 56, 202, 270.1, 616

[56] References Cited

U.S. PATENT DOCUMENTS

| | | | |
|---|---|---|---|
| 2,271,234 | 6/1940 | Staud et al. | 430/514 |
| 2,327,828 | 3/1941 | Simmons | 430/513 |
| 4,565,683 | 1/1986 | Yates et al. | 423/447.3 |
| 4,663,230 | 5/1987 | Tennent | 428/367 |
| 5,149,584 | 9/1992 | Baker et al. | 429/297 |
| 5,165,909 | 11/1992 | Tennent et al. | 423/447.3 |
| 5,171,560 | 12/1992 | Tennent | 423/447.3 |
| 5,308,727 | 5/1994 | Osawa et al. | 430/58 |
| 5,340,676 | 8/1994 | Anderson et al. | 430/527 |
| 5,360,669 | 11/1994 | Noland et al. | 428/408 |
| 5,374,415 | 12/1994 | Alig et al. | 423/447.3 |

OTHER PUBLICATIONS

N. M. Rodriquez, "A Review of Catalytically Grown Carbon Nanofibers", *J. Mater Res.*, vol. 8, No. 12, pp. 3233–3250, Dec. 1993.

Endo et al, "Formation of Carbon Nanofibers", *J. Phys. Chem.*, 96, 6941–6944, 1992.

Ajayan et al, "Growth of Manganese Filled Carbon Nanofibers in the Vapor Phase", *Physical Review Letters*, vol. 72, No. 11, 1722–1725, Mar. 1994.

Rodriquez et al, "Carbon Nanofibers: A Unique Catalyst Support Medium", *J. Phys. Chem.*, 98, 13108–13111, 1994.

Downs et al, "Modification of the Surface Properties of Carbon Fibers Via the Catalytic Growth of Carbon Nanofibers", *J. Mater Res.*, vol. 10, No. 3, 625–633, Mar., 1995.

*Primary Examiner*—Geraldine Letscher

*Attorney, Agent, or Firm*—Alfred P. Lorenzo; Carl F. Ruoff

[57] ABSTRACT

Imaging elements, such as photographic, electrostatographic and thermal imaging elements, are comprised of a support, an image-forming layer and an electrically-conductive layer comprising a dispersion of carbon nanofibers in a film-forming binder. Use of carbon nanofibers provides a controlled degree of electrical conductivity and beneficial chemical, physical and optical properties which adapt the electrically-conductive layer for such purposes as providing protection against static or serving as an electrode which takes part in an image-forming process.

30 Claims, 3 Drawing Sheets

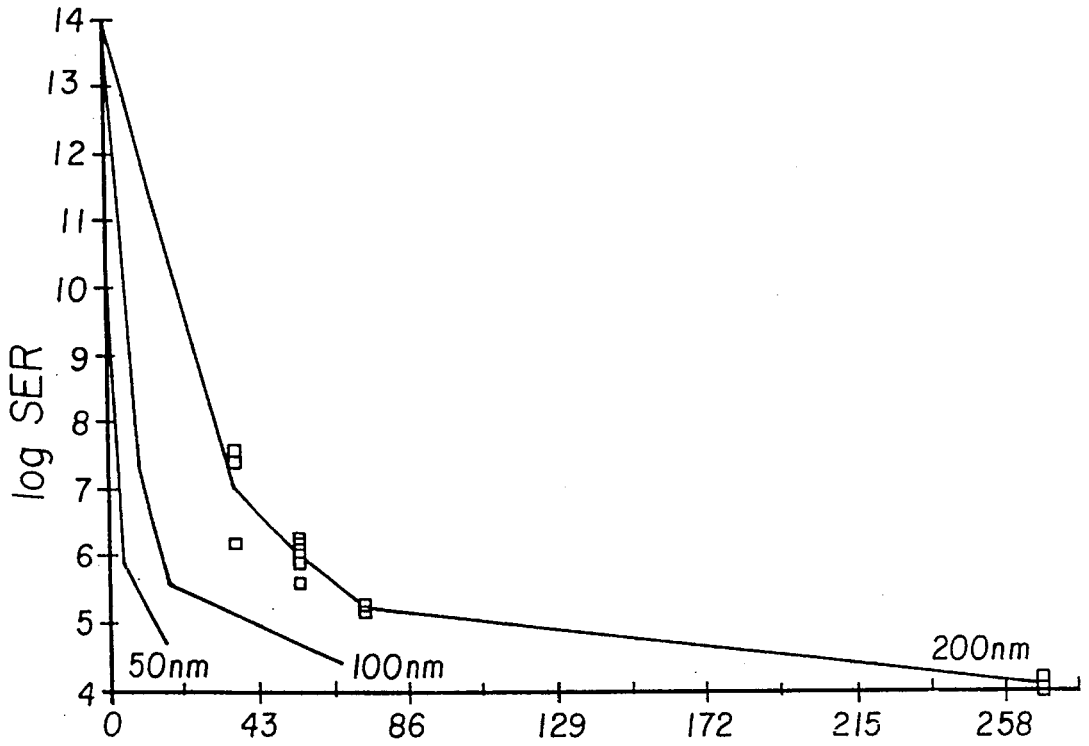
FIG. 1 Carbon Coverage, mg/square meter
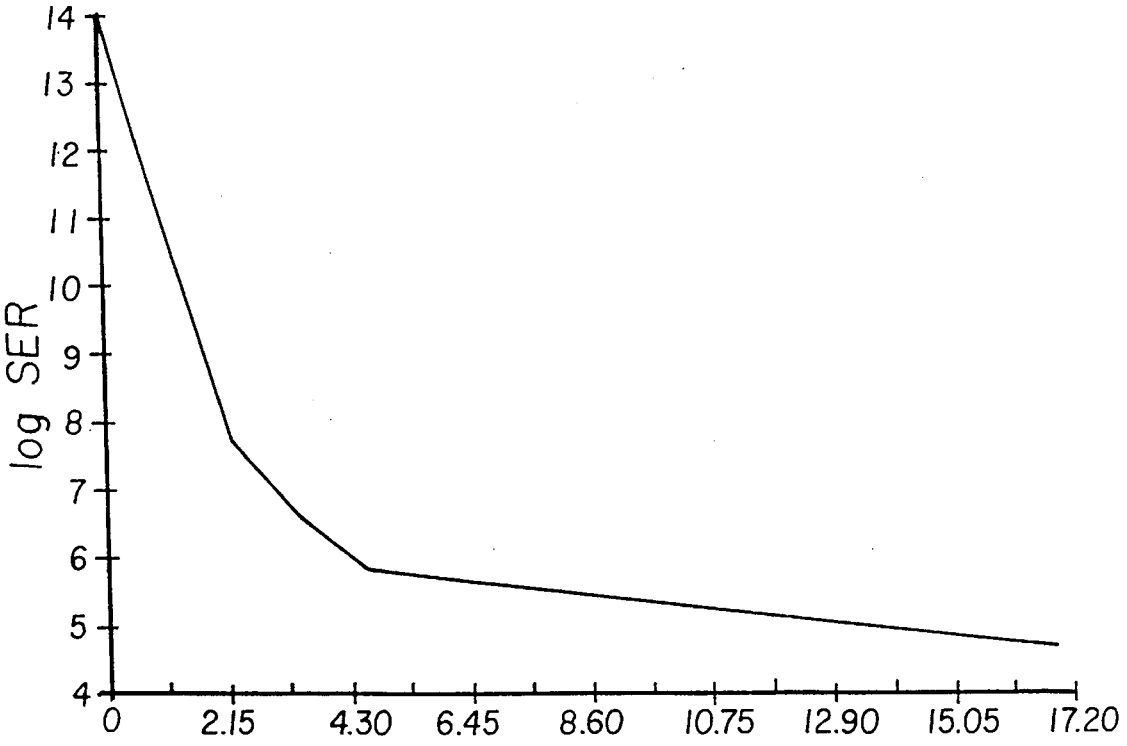
FIG. 2 Carbon Coverage, mg/square meter

IMAGING ELEMENT HAVING AN ELECTRICALLY-CONDUCTIVE LAYER

FIELD OF THE INVENTION

This invention relates in general to imaging elements, such as photographic, electrostatographic and thermal imaging elements, and in particular to imaging elements comprising a support, an image-forming layer and an electrically-conductive layer. More specifically, this invention relates to electrically-conductive layers combining the advantages of chemical inertness and humidity-independent conductivity and to the use of such electrically-conductive layers in imaging elements for such purposes as providing protection against the generation of static electrical charges or serving as an electrode which takes part in an image-forming process.

BACKGROUND OF THE INVENTION

Problems associated with the formation and discharge of electrostatic charge during the manufacture and utilization of photographic film and paper have been recognized for many years by the photographic industry. The accumulation of charge on film or paper surfaces leads to the attraction of dust, which can produce physical defects. The discharge of accumulated charge during or after the application of the sensitized emulsion layer(s) can produce irregular fog patterns or "static marks" in the emulsion. The severity of static problems has been exacerbated greatly by increases in the sensitivity of new emulsions, increases in coating machine speeds, and increases in post-coating drying efficiency. The charge generated during the coating process results primarily from the tendency of webs of high dielectric polymeric film base to charge during winding and unwinding operations (unwinding static), during transport through the coating machines (transport static), and during post-coating operations such as slitting and spooling. Static charge can also be generated during the use of the finished photographic film product. In an automatic camera, the winding of roll film out of and back into the film cassette, especially in a low relative humidity environment, can result in static charging. Similarly, high-speed automated film processing can result in static charge generation. Sheet films are especially subject to static charging during removal from light-tight packaging (e.g., x-ray films).

It is generally known that electrostatic charge can be dissipated effectively by incorporating one or more electrically-conductive "antistatic" layers into the film structure. Antistatic layers can be applied to one or to both sides of the film base as subbing layers either beneath or on the side opposite to the light-sensitive silver halide emulsion layers. An antistatic layer can alternatively be applied as an outer coated layer either over the emulsion layers or on the side of the film base opposite to the emulsion layers or both. For some applications, the antistatic agent can be incorporated into the emulsion layers. Alternatively, the antistatic agent can be directly incorporated into the film base itself.

A wide variety of electrically-conductive materials can be incorporated into antistatic layers to produce a wide range of conductivities. Most of the traditional antistatic systems for photographic applications employ ionic conductors. Charge is transferred in ionic conductors by the bulk diffusion of charged species through an electrolyte. Antistatic layers containing simple inorganic salts, alkali metal salts of surfactants, ionic conductive polymers, polymeric electrolytes containing alkali metal salts, and colloidal metal oxide sols (stabilized by metal salts) have been described previously. The conductivities of these ionic conductors are typically strongly dependent on the temperature and relative humidity in their environment. At low humidities and temperatures, the diffusional mobilities of the ions are greatly reduced and conductivity is substantially decreased. At high humidities, antistatic backcoatings often absorb water, swell, and soften. In roll film, this results in adhesion of the backcoating to the emulsion side of the film. Also, many of the inorganic salts, polymeric electrolytes, and low molecular weight surfactants used are water-soluble and are leached out of the antistatic layers during processing, resulting in a loss of antistatic function.

Colloidal metal oxide sols which exhibit ionic conductivity when included in antistatic layers are often used in imaging elements. Typically, alkali metal salts or anionic surfactants are used to stabilize these sols. A thin antistatic layer consisting of a gelled network of colloidal metal oxide particles (e.g., silica, antimony pentoxide, alumina, titania, stannic oxide, zirconia) with an optional polymeric binder to improve adhesion to both the support and overlying emulsion layers has been disclosed in EP 250,154. An optional ambifunctional silane or titanate coupling agent can be added to the gelled network to improve adhesion to overlying emulsion layers (e.g., EP 301,827; U.S. Pat. No. 5,204,219) along with an optional alkali metal orthosilicate to minimize loss of conductivity by the gelled network when it is overcoated with gelatin-containing layers (U.S. Pat. No. 5,236,818). Also, it has been pointed out that coatings containing colloidal metal oxides (e.g., antimony pentoxide, alumina, tin oxide, indium oxide) and colloidal silica with an organopolysiloxane binder afford enhanced abrasion resistance as well as provide antistatic function (U.S. Pat. Nos. 4,442,168 and 4,571,365).

Antistatic systems employing electronic conductors have also been described. Because the conductivity depends predominantly on electronic mobilities rather than ionic mobilities, the observed electronic conductivity is independent of relative humidity and only slightly influenced by the ambient temperature. Antistatic layers have been described which contain conjugated polymers, conductive carbon particles or semiconductive inorganic particles.

Trevoy (U.S. Pat. No. 3,245,833) has taught the preparation of conductive coatings containing semiconductive silver or copper iodide dispersed as particles less than 0.1 μm in size in an insulating film-forming binder, exhibiting a surface resistivity of $10^2$ to $10^{11}$ ohms per square. The conductivity of these coatings is substantially independent of the relative humidity. Also, the coatings are relatively clear and sufficiently transparent to permit their use as antistatic coatings for photographic film. However, if a coating containing copper or silver iodides was used as a subbing layer on the same side of the film base as the emulsion, Trevoy found (U.S. Pat. No. 3,428,451) that it was necessary to overcoat the conductive layer with a dielectric, water-impermeable barrier layer to prevent migration of semiconductive salt into the silver halide emulsion layer during processing. Without the barrier layer, the semiconductive salt could interact deleteriously with the silver halide layer to form fog and a loss of emulsion sensitivity. Also, without a barrier layer, the semiconductive salts are solubilized by processing solutions, resulting in a loss of antistatic function.

Another semiconductive material has been disclosed by Nakagiri and Inayama (U.S. Pat. No. 4,078,935) as being useful in antistatic layers for photographic applications. Transparent, binderless, electrically semiconductive metal oxide thin films were formed by oxidation of thin metal films which had been vapor deposited onto film base. Suitable transition metals include titanium, zirconium, vanadium, and niobium. The microstructure of the thin metal oxide films is revealed to be non-uniform and discontinuous, with an "island" structure almost "particulate" in nature. The surface resistivity of such semiconductive metal oxide thin films is independent of relative humidity and reported to range from $10^5$ to $10^9$ ohms per square. However, the metal oxide thin films are unsuitable for photographic applications since the overall process used to prepare these thin films is complicated and costly, abrasion resistance of these thin films is low, and adhesion of these thin films to the base is poor.

A highly effective antistatic layer incorporating an "amorphous" semiconductive metal oxide has been disclosed by Guestaux (U.S. Pat. No. 4,203,769). The antistatic layer is prepared by coating an aqueous solution containing a colloidal gel of vanadium pentoxide onto a film base. The colloidal vanadium pentoxide gel typically consists of entangled, high aspect ratio, flat ribbons 50–100 Å wide, about 10 Å thick, and 1,000–10,000 Å long. These ribbons stack flat in the direction perpendicular to the surface when the gel is coated onto the film base. This results in electrical conductivities for thin films of vanadium pentoxide gels (about 1 $\Omega^{-1}cm^{-1}$) which are typically about three orders of magnitude greater than is observed for similar thickness films containing crystalline vanadium pentoxide particles. In addition, low surface resistivities can be obtained with very low vanadium pentoxide coverages. This results in low optical absorption and scattering losses. Also, the thin films are highly adherent to appropriately prepared film bases. However, vanadium pentoxide is soluble at high pH and must be overcoated with a non-permeable, hydrophobic barrier layer in order to survive processing. When used with a conductive subbing layer, the barrier layer must be coated with a hydrophilic layer to promote adhesion to emulsion layers above. (See Anderson et al, U.S. Pat. No. 5,006,451.)

Conductive fine particles of crystalline metal oxides dispersed with a polymeric binder have been used to prepare optically transparent, humidity insensitive, antistatic layers for various imaging applications. Many different metal oxides—such as ZnO, $TiO_2$, $ZrO_2$, $SnO_2$, $Al_2O_3$, $In_2O_3$, $SiO_2$, MgO, BaO, $MoO_3$ and $V_2O_5$—are alleged to be useful as antistatic agents in photographic elements or as conductive agents in electrostatographic elements in such patents as U.S. Pat. Nos. 4,275,103, 4,394,441, 4,416,963, 4,418,141, 4,431,764, 4,495,276, 4,571,361, 4,999,276 and 5,122,445. However, many of these oxides do not provide acceptable performance characteristics in these demanding environments. Preferred metal oxides are antimony doped tin oxide, aluminum doped zinc oxide, and niobium doped titanium oxide. Surface resistivities are reported to range from $10^6$–$10^9$ ohms per square for antistatic layers containing the preferred metal oxides. In order to obtain high electrical conductivity, a relatively large amount (0.1–10 $g/m^2$) of metal oxide must be included in the antistatic layer. This results in decreased optical transparency for thick antistatic coatings. The high values of refractive index (>2.0) of the preferred metal oxides necessitates that the metal oxides be dispersed in the form of ultrafine (<0.1 μm) particles in order to minimize light scattering (haze) by the antistatic layer.

Antistatic layers comprising electro-conductive ceramic particles, such as particles of TiN, $NbB_2$, TiC, $LaB_6$ or MoB, dispersed in a binder such as a water-soluble polymer or solvent-soluble resin are described in Japanese Kokai No. 4/55492, published Feb. 24, 1992.

Fibrous conductive powders comprising antimony-doped tin oxide coated onto non-conductive potassium titanate whiskers have been used to prepare conductive layers for photographic and electrographic applications. Such materials are disclosed, for example, in U.S. Pat. Nos. 4,845,369 and 5,116,666. Layers containing these conductive whiskers dispersed in a binder reportedly provide improved conductivity at lower volumetric concentrations than other conductive fine particles as a result of their higher aspect ratio. However, the benefits obtained as a result of the reduced volume percentage requirements are offset by the fact that these materials are relatively large in size such as 10 to 20 micrometers in length, and such large size results in increased light scattering and hazy coatings.

Use of a high volume percentage of conductive particles in an electro-conductive coating to achieve effective antistatic performance can result in reduced transparency due to scattering losses and in the formation of brittle layers that are subject to cracking and exhibit poor adherence to the support material. It is thus apparent that it is extremely difficult to obtain non-brittle, adherent, highly transparent, colorless electro-conductive coatings with humidity-independent process-surviving antistatic performance.

The requirements for antistatic layers in silver halide photographic films are especially demanding because of the stringent optical requirements. Other types of imaging elements such as photographic papers and thermal imaging elements also frequently require the use of an antistatic layer but, generally speaking, these imaging elements have less stringent requirements.

Electrically-conductive layers are also commonly used in imaging elements for purposes other than providing static protection. Thus, for example, in electrostatographic imaging it is well known to utilize imaging elements comprising a support, an electrically-conductive layer that serves as an electrode, and a photoconductive layer that serves as the image-forming layer. Electrically-conductive agents utilized as antistatic agents in photographic silver halide imaging elements are often also useful in the electrode layer of electrostatographic imaging elements.

As indicated above, the prior art on electrically-conductive layers in imaging elements is extensive and a very wide variety of different materials have been proposed for use as the electrically-conductive agent. There is still, however, a critical need in the art for improved electrically-conductive layers which are useful in a wide variety of imaging elements, which can be manufactured at reasonable cost, which are resistant to the effects of humidity change, which are durable and abrasion-resistant, which are effective at low coverage, which are adaptable to use with transparent imaging elements, which do not exhibit adverse sensitometric or photographic effects, and which are substantially insoluble in solutions with which the imaging element typically comes in contact, for example, the aqueous alkaline developing solutions used to process silver halide photographic films.

While the use of metal oxide particles in imaging elements as hereinabove described has many advantages, it also has significant disadvantages which have hindered its commercial application. Thus, for example, the metal oxide particles are relatively costly. Also, metal oxide particles suffer from the disadvantage that they impart excessive wear on perforating and slitting equipment that is commonly used with imaging elements. A further problem with metal oxide particles relates to the environmental concerns associated with the disposal of wastes containing heavy metals.

It is toward the objective of providing improved electrically-conductive layers that more effectively meet the diverse needs of imaging elements—especially of silver halide photographic films but also of a wide range of other imaging elements—than those of the prior art that the present invention is directed.

SUMMARY OF THE INVENTION

In accordance with this invention, an imaging element for use in an image-forming process comprises a support, an image-forming layer, and an electrically-conductive layer; the electrically-conductive layer comprising a dispersion of carbon nanofibers in a film-forming binder.

The imaging elements of this invention can contain one or more image-forming layers and one or more electrically-conductive layers and such layers can be coated on any of a very wide variety of supports. Use of carbon nanofibers dispersed in a suitable film-forming binder enables the preparation of a thin, highly conductive, transparent layer which is strongly adherent to photographic supports as well as to overlying layers such as emulsion layers, pelloids, topcoats, backcoats, and the like. The electrical conductivity provided by the conductive layer of this invention is independent of relative humidity and persists even after exposure to aqueous solutions with a wide range of pH values (i.e., $1 \leqq pH \leqq 13$) such as are encountered in the processing of photographic elements.

Carbon nanofibers are well known materials that have found a variety of uses. Thus, for example, N. M. Rodriguez "A Review Of Catalytically Grown Carbon Nanofibers", *J. Mater Res.*, Vol. 8, No. 12, pages 3233–3250, December, 1993, describes their use as catalysts and catalyst supports, as adsorption agents, in fibrous composites and in energy storage devices. However, heretofore there has been no disclosure of the use of carbon nanofibers in an electrically-conductive layer of an imaging element.

Patents and publications pertaining to carbon nanofibers, to methods for their preparation and to articles and compositions in which they are usefully employed include:

(1) Yates et al, U.S. Pat. No. 4,565,683 "Production Of Carbon Filaments" issued Jan. 21, 1986.

(2) Tennent, U.S. Pat. No. 4,663,230 "Carbon Fibrils, Method For Producing Same And Compositions Containing Same" issued May 5, 1987.

(3) Tennent et al, U.S. Pat. No. 5,165,909 "Carbon Fibrils And Method For Producing Same" issued Nov. 24, 1992.

(4) Baker et al, U.S. Pat. No. 5,149,584 "Carbon Fiber Structures Having Improved Interlaminar Properties" issued Sep. 22, 1992.

(5) Tennent, U.S. Pat. No. 5,171,560 "Carbon Fibrils, Method For Producing Same, and Encapsulated Catalyst" issued Dec. 15, 1992.

(6) Noland et al, U.S. Pat. No. 5,360,669 "Carbon Fibers" issued Nov. 1, 1994.

(7) Alig et al, U.S. Pat. No. 5,374,415 "Method For Forming Carbon Fibers" issued Dec. 20, 1994.

(8) Endo et al, "Formation Of Carbon Nanofibers" *J. Phys. Chem.*, 96, 6941–6944, 1992.

(9) Ajayan et al, "Growth Of Manganese Filled Carbon Nanofibers In The Vapor Phase" *Physical Review Letters*, Vol. 72, No. 11, 1722–1725, Mar. 14, 1994.

(10) Rodriguez et al, "Carbon Nanofibers: A Unique Catalyst Support Medium", *J. Phys. Chem.*, 98, 13108–13111, 1994.

(11) Downs et al, "Modification Of The Surface Properties Of Carbon Fibers Via The Catalytic Growth Of Carbon Nanofibers", *J. Mater Res.* Vol. 10, No. 3, 625–633, March 1995.

The term "nanofiber", as used herein, is intended to include fibers in the form of hollow tubes and fibers in the form of solid cylinders and is intended to encompass fibers with diameters in the range of from 1 to 1000 nanometers and lengths in the range of from 1 to 100 micrometers. Terms such as "carbon filaments" and "carbon fibrils" are used in the art as alternatives to the term "carbon nanofibers."

The use of carbon nanofibers in imaging elements in accordance with this invention has many advantages. Thus, for example, substantially clear antistatic coatings can be prepared from aqueous dispersions of carbon nanofibers in suitable film-forming binders. Both the high degree of electrical conductivity and the low optical density required of electrically-conductive layers in many imaging applications are readily achieved by the use of carbon nanofibers. Use of carbon nanofibers provides electrically-conductive layers whose performance is humidity-independent and process surviving. In particular, the conductivity will survive contact with solutions over a wide range of pH, representing the most extreme conditions expected in any photographic process. No protective overcoat which overlies the electrically-conductive layer is needed. The cost of using the carbon nanofibers is low, especially considering the extremely low coverages in which they can be employed. They are chemically inert at room temperature, thereby minimizing the possibility of unwanted interaction with other components of an imaging system. They are environmentally benign and require only the precautions needed with any finely-divided material. On balance, they offer a combination of attributes unmatched in its entirety by any other electrically-conductive material known to be useful in imaging elements.

The use of carbon particles to form conductive layers in imaging elements is well known in the art. Thus, for example, colloidal carbon antihalation layers, which provide both antistatic and antihalation characteristics, have been utilized in photographic films for many years and are described, for example, in U.S. Pat. Nos. 2,271,234 and 2,327,828. Such layers are, however, relatively opaque and, as a consequence, must be removed in the process so they do not provide process-surviving antistatic protection. In marked contrast, the electrically-conductive layers of this invention are transparent layers which provide antistatic protection both before and after processing. Transparency is achieved as a consequence of the extremely small diameters of carbon nanofibers and the fact that only very small amounts are required to provide the desired degree of electrical conductivity. The ability to use very low coverage of carbon nanofibers is attributable to the fact that fibers have a geometric configuration, as contrasted for example with spheres, that is especially well suited to form the interconnected network that is needed to provide a continuous electrical path.

Carbon nanofibers are similar in performance to vanadium pentoxide which, because of its morphology, is known to be one of the most effective electrically-conductive agents for use in imaging elements (see, for example, U.S. Pat. No. 5,006,451). However, unlike vanadium pentoxide which is soluble in processing solutions, carbon nanofibers are highly resistant to processing solutions and thus are able to provide process-surviving antistatic protection.

BRIEF DESCRIPTION OF THE DRAWINGS

FIG. 1 is a plot of surface resistivity (SER) versus carbon coverage and presents experimental data for carbon nanofibers with a nominal diameter of 200 nanometers and curves derived by calculation for nominal diameters of 100 and 50 nanometers respectively.

FIG. 2 is a plot on an expanded scale of surface resistivity (SER) versus carbon coverage of the 50 nanometer carbon nanofibers of FIG. 1.

DESCRIPTION OF THE PREFERRED EMBODIMENTS

Figure 3:
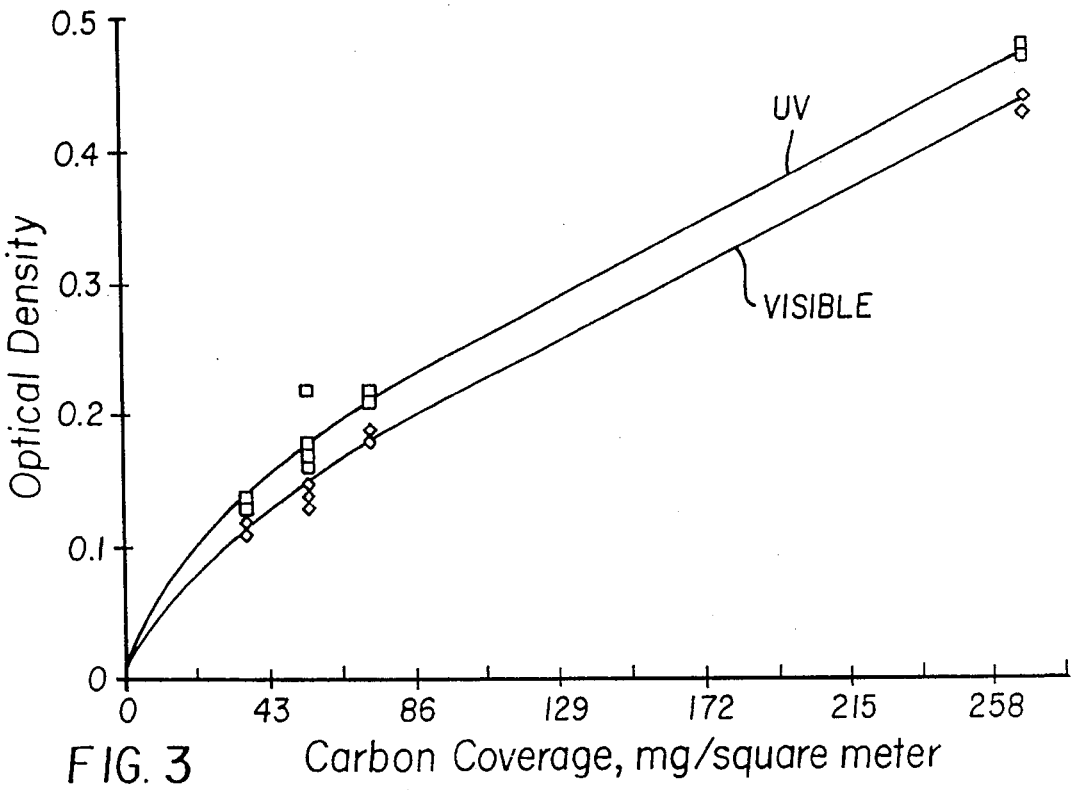
FIG. 3 is a plot of optical density versus carbon coverage for carbon nanofibers with a nominal diameter of 200 nanometers and presents experimental data for both the ultraviolet and visible regions of the spectrum.

The imaging elements of this invention can be of many different types depending on the particular use for which they are intended. Such elements include, for example, photographic, electrostatographic, photothermographic, migration, electrothermographic, dielectric recording and thermal-dye-transfer imaging elements.

Photographic elements which can be provided with an antistatic layer in accordance with this invention can differ widely in structure and composition. For example, they can vary greatly in regard to the type of support, the number and composition of the image-forming layers, and the kinds of auxiliary layers that are included in the elements. In particular, the photographic elements can be still films, motion picture films, x-ray films, graphic arts films, paper prints or microfiche. They can be black-and-white elements, color elements adapted for use in a negative-positive process, or color elements adapted for use in a reversal process.

Photographic elements can comprise any of a wide variety of supports. Typical supports include cellulose nitrate film, cellulose acetate film, poly(vinyl acetal) film, polystyrene film, poly(ethylene terephthalate) film, poly(ethylene naphthalate) film, polycarbonate film, glass, metal, paper, polymer-coated paper, and the like. The image-forming layer or layers of the element typically comprise a radiation-sensitive agent, e.g., silver halide, dispersed in a hydrophilic water-permeable colloid. Suitable hydrophilic vehicles include both naturally-occurring substances such as proteins, for example, gelatin, gelatin derivatives, cellulose derivatives, polysaccharides such as dextran, gum arabic, and the like, and synthetic polymeric substances such as water-soluble polyvinyl compounds like poly(vinylpyrrolidone), acrylamide polymers, and the like. A particularly common example of an image-forming layer is a gelatin-silver halide emulsion layer.

In electrostatography an image comprising a pattern of electrostatic potential (also referred to as an electrostatic latent image) is formed on an insulative surface by any of various methods. For example, the electrostatic latent image may be formed electrophotographically (i.e., by imagewise radiation-induced discharge of a uniform potential previously formed on a surface of an electrophotographic element comprising at least a photoconductive layer and an electrically-conductive substrate), or it may be formed by dielectric recording (i.e., by direct electrical formation of a pattern of electrostatic potential on a surface of a dielectric material). Typically, the electrostatic latent image is then developed into a toner image by contacting the latent image with an electrographic developer (if desired, the latent image can be transferred to another surface before development). The resultant toner image can then be fixed in place on the surface by application of heat and/or pressure or other known methods (depending upon the nature of the surface and of the toner image) or can be transferred by known means to another surface, to which it then can be similarly fixed.

In many electrostatographic imaging processes, the surface to which the toner image is intended to be ultimately transferred and fixed is the surface of a sheet of plain paper or, when it is desired to view the image by transmitted light (e.g., by projection in an overhead projector), the surface of a transparent film sheet element.

In electrostatographic elements, the electrically-conductive layer can be a separate layer, a part of the support layer or the support layer. There are many types of conducting layers known to the electrostatographic art, the most common being listed below:

(a) metallic laminates such as an aluminum-paper laminate, (b) metal plates, e.g., aluminum, copper, zinc, brass, etc., (c) metal foils such as aluminum foil, zinc foil, etc., (d) vapor deposited metal layers such as silver, aluminum, nickel, etc., (e) semiconductors dispersed in resins such as poly(ethylene terephthalate) as described in U.S. Pat. No. 3,245,833, (f) electrically conducting salts such as described in U.S. Pat. Nos. 3,007,801 and 3,267,807.

Conductive layers (d), (e) and (f) can be transparent and can be employed where transparent elements are required, such as in processes where the element is to be exposed from the back rather than the front or where the element is to be used as a transparency.

Thermally processable imaging elements, including films and papers, for producing images by thermal processes are well known. These elements include thermographic elements in which an image is formed by imagewise heating the element. Such elements are described in, for example, *Research Disclosure*, June 1978, Item No. 17029; U.S. Pat. No. 3,457,075; U.S. Pat. No. 3,933,508; and U.S. Pat. No. 3,080,254.

Photothermographic elements typically comprise an oxidation-reduction image-forming combination which contains an organic silver salt oxidizing agent, preferably a silver salt of a long-chain fatty acid. Such organic silver salt oxidizing agents are resistant to darkening upon illumination. Preferred organic silver salt oxidizing agents are silver salts of long-chain fatty acids containing 10 to 30 carbon atoms. Examples of useful organic silver salt oxidizing agents are silver behenate, silver stearate, silver oleate, silver laurate, silver hydroxystearate, silver caprate, silver myristate and silver palmitate. Combinations of organic silver salt oxidizing agents are also useful. Examples of useful silver salt oxidizing agents which are not silver salts of long-chain fatty acids include, for example, silver benzoate and silver benzotriazole.

Photothermographic elements also comprise a photosensitive component which consists essentially of photographic silver halide. In photothermographic materials it is believed that the latent image silver from the silver halide acts as a catalyst for the oxidation-reduction image-forming combination upon processing. A preferred concentration of photographic silver halide is within the range of about 0.01 to about 10 moles of photographic silver halide per mole of organic silver salt oxidizing agent, such as per mole of silver behenate, in the photothermographic material. Other photosensitive silver salts are useful in combination with the photographic silver halide if desired. Preferred photographic silver halides are silver chloride, silver bromide, silver bromoiodide, silver chlorobromoiodide and mixtures of these silver halides. Very fine grain photographic silver halide is especially useful.

Migration imaging processes typically involve the arrangement of particles on a softenable medium. Typically, the medium, which is solid and impermeable at room temperature, is softened with heat or solvents to permit particle migration in an imagewise pattern.

As disclosed in R. W. Gundlach, "Xeroprinting Master with Improved Contrast Potential", *Xerox Disclosure Journal*, Vol. 14, No. 4, July/August 1984, pages 205–06, migration imaging can be used to form a xeroprinting master element. In this process, a monolayer of photosensitive particles is placed on the surface of a layer of polymeric material which is in contact with a conductive layer. After charging, the element is subjected to imagewise exposure which softens the polymeric material and causes migration of particles where such softening occurs (i.e., image areas). When the element is subsequently charged and exposed, the image areas (but not the non-image areas) can be charged, developed, and transferred to paper.

Another type of migration imaging technique, disclosed in U.S. Pat. No. 4,536,457 to Tam, U.S. Pat. No. 4,536,458 to Ng, and U.S. Pat. No. 4,883,731 to Tam et al, utilizes a solid migration imaging element having a substrate and a layer of softenable material with a layer of photosensitive marking material deposited at or near the surface of the softenable layer. A latent image is formed by electrically charging the member and then exposing the element to an imagewise pattern of light to discharge selected portions of the marking material layer. The entire softenable layer is then made permeable by application of the marking material, heat or a solvent, or both. The portions of the marking material which retain a differential residual charge due to light exposure will then migrate into the softened layer by electrostatic force.

An imagewise pattern may also be formed with colorant particles in a solid imaging element by establishing a density differential (e.g., by particle agglomeration or coalescing) between image and non-image areas. Specifically, colorant particles are uniformly dispersed and then selectively migrated so that they are dispersed to varying extents without changing the overall quantity of particles on the element.

Another migration imaging technique involves heat development, as described by R. M. Schaffert, *Electrophotography*, (Second Edition, Focal Press, 1980), pp. 44–47 and U.S. Pat. No. 3,254,997. In this procedure, an electrostatic image is transferred to a solid imaging element, having colloidal pigment particles dispersed in a heat-softenable resin film on a transparent conductive substrate. After softening the film with heat, the charged colloidal particles migrate to the oppositely charged image. As a result, image areas have an increased particle density, while the background areas are less dense.

An imaging process known as "laser toner fusion", which is a dry electrothermographic process, is also of significant commercial importance. In this process, uniform dry powder toner depositions on non-photosensitive films, papers, or lithographic printing plates are imagewise exposed with high power (0.2–0.5 W) laser diodes thereby, "tacking" the toner particles to the substrate(s). The toner layer is made, and the non-imaged toner is removed, using such techniques as electrographic "magnetic brush" technology similar to that found in copiers. A final blanket fusing step may also be needed, depending on the exposure levels.

Another example of imaging elements which employ an antistatic layer are dye-receiving elements used in thermal dye transfer systems.

Thermal dye transfer systems are commonly used to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are described in U.S. Pat. No. 4,621,271.

In EPA No. 194,106, antistatic layers are disclosed for coating on the back side of a dye-receiving element. Among the materials disclosed for use are electrically-conductive inorganic powders such as a "fine powder of titanium oxide or zinc oxide."

Another type of image-forming process in which the imaging element can make use of an electrically-conductive layer is a process employing an imagewise exposure to electric current of a dye-forming electrically-activatable recording element to thereby form a developable image followed by formation of a dye image, typically by means of thermal development. Dye-forming electrically activatable recording elements and processes are well known and are described in such patents as U.S. Pat. No. 4,343,880 and 4,727,008.

In the imaging elements of this invention, the image-forming layer can be any of the types of image-forming layers described above, as well as any other image-forming layer known for use in an imaging element.

All of the imaging processes described hereinabove, as well as many others, have in common the use of an electrically-conductive layer as an electrode or as an antistatic layer. The requirements for a useful electrically-conductive layer in an imaging environment are extremely demanding and thus the art has long sought to develop improved electrically-conductive layers exhibiting the necessary combination of physical, optical and chemical properties.

As described hereinabove, the imaging elements of this invention include at least one electrically-conductive layer comprising a dispersion of carbon nanofibers in a film-forming binder.

Carbon nanofibers are defined herein as being carbon fibers with diameters in the range of from 1 to 1000 nanometers and lengths in the range of from 1 to 100 micrometers. Use of carbon fibers of significantly larger or smaller dimensions is undesirable as excessively small fibers will not provide the desired electrical conductivity for use in imaging elements and excessively large fibers will seriously detract from the desired transparency.

Preferred carbon nanofibers for use herein have a diameter of less than 500 nanometers, more preferably less than 200 nanometers and most preferably less than 100 nanometers. Advantageously, the carbon nanofibers utilized in this invention have a length to diameter ratio of at least 20, more preferably at least 50, and a surface area in the range of from about 5 to about 250 $m^2$/gram.

The weight ratio of carbon nanofibers to film-forming binder in the electrically conductive layer of this invention is preferably in the range of from 0.01 to 1 to 100 to 1, more preferably in the range of from 0.1 to 1 to 10 to 1, and most preferably in the range of from 0.5 to 1 to 2 to 1.

The carbon nanofibers utilized in this invention preferably have a "powder" resistivity of less than one ohm-cm.

The coverage in which the carbon nanofibers are utilized will depend on the specific requirements of the imaging element. Preferred coverage, based on weight of carbon, is from 1 to 300 mg/$m^2$ and more preferred is from 2 to 50 mg/$m^2$.

Film-forming binders useful in the electrically-conductive layers of this invention include: water-soluble polymers such as gelatin, gelatin derivatives, maleic acid anhydride copolymers; cellulose compounds such as carboxymethyl cellulose, hydroxyethyl cellulose, cellulose acetate butyrate, diacetyl cellulose or triacetyl cellulose; synthetic hydrophilic polymers such as polyvinyl alcohol, poly-N-vinylpyrrolidone, acrylic acid copolymers, polyacrylamides, their derivatives and partially hydrolyzed products, vinyl polymers and copolymers such as polyvinyl acetate and polyacrylate acid esters; derivatives of the above polymers; and other synthetic resins. Other suitable binders include aqueous emulsions of addition-type polymers and interpolymers prepared from ethylenically unsaturated monomers such as acrylates including acrylic acid, methacrylates including methacrylic acid, acrylamides and methacrylamides, itaconic acid and its half-esters and diesters, styrenes including substituted styrenes, acrylonitrile and methacrylonitrile, vinyl acetates, vinyl ethers, vinyl and vinylidene halides, olefins, and aqueous dispersions of polyurethanes or polyesterionomers.

An additional class of film-forming binders that are useful in this invention are the polyalkoxysilanes. Compounds of this class include those represented by the formulae I or II as follows:

$$Si(OR_1)_4 \qquad \text{I}$$

$$R_2—Si(OR_3)_3 \qquad \text{II}$$

wherein $R_1$ and $R_3$ are individually unsubstituted or substituted alkyl containing 1 to 4 carbon atoms, such as methyl, ethyl, propyl and butyl, and $R_2$ is unsubstituted or substituted alkyl, such as alkyl containing 1 to 22 carbon atoms, such as methyl, ethyl, propyl, butyl, and n-octadecyl; or unsubstituted or substituted phenyl.

Specific examples of useful polyalkoxysilanes for the purpose of this invention include:

$Si(OC_2H_5)_4$ $Si(OCH_3)_4$ $CH_3Si(OC_2H_5)_3$ $CH_3Si(OCH_3)_3$ $C_6H_5Si(OC_2H_5)_3$ $C_6H_5Si(OCH_3)_3$ $NH_2CH_2CH_2CH_2Si(OC_2H_5)_3$ $NH_2CH_2CH_2CH_2Si(OCH_3)_3$

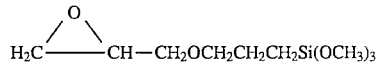

and $CH_3(CH_2)_{17}Si(OC_2H_5)_3$.

Film-forming binders referred to in the art as polyesterionomers or polyesteranionomers are especially useful herein. The term anionic polyesterionomer or polyesteranionomer refers to polyesters that contain at least one anionic moiety. Such anionic moieties function to make the polymer water dispersible.

The polyesteranionomer binders that are particularly useful in this invention include those polyesters having carboxylic acid groups, metal salts of carboxylic acids, sulfonic acid groups and metal salts of sulfonic acids. The metal salts may be sodium, lithium or potassium salts. The polyesteranionomers are prepared by including in the preparation of the polyester a compound that will react to form a polymeric backbone but will also contain anionic groups. Such compounds include tricarboxylic acids, such as 1,3,5-benzene tricarboxylic acid, 1,4,6-naphthylene tricarboxylic acid, metal salts of tricarboxylic acids such as those having two carboxylic acid groups for esterification reaction and the third being a metal salt of a carboxylic acid group, such as, 2,6-dibenzoic acid-5-sodiocarboxylate, 5-sodiocarboxyisophthalic acid, 4-sodiocarboxy-2,7-naphthalenedicarboxylate, the corresponding lithium and potassium salts and the like; sulfonyl group containing dicarboxylic acids such as, hydroxy sulfonylterephthalic acids, hydroxy sulfonylisophthalic acid, especially 5-sulfoisophthalic acid, 4-hydroxy sulfonyl-2,7-naphthalene dicarboxylic acid, and the like; the corresponding alkali metal sulfodicarboxylic acids and the like.

Typically the anionic moiety is provided by some of the dicarboxylic acid repeat units, the remainder of the dicarboxylic acid repeat units are nonionic in nature. Preferably the anionic dicarboxylic acid contains a sulfonic acid group or its metal salt. Examples include the sodium, lithium, or potassium salt of sulfoterephthalic acid, sulfonaphthalene dicarboxylic acid, sulfophthalic acid, and sulfoisophthalic acid or their functionally equivalent anhydride, diester, or diacid halide. Most preferably the ionic dicarboxylic acid repeat unit is provided by 5-sodiosulfoisophthalic acid or dimethyl 5-sodiosulfoisophthalate.

These polyesters are prepared by reacting one or more dicarboxylic acids or their functional equivalents such as anhydrides, diesters, or diacid halides with one or more diols in melt phase polycondensation techniques well known in the art (see, for example, U.S. Pat. Nos. 3,018,272; 3,929,489, 4,307,174; 4,419,437). Examples of this class of polymers include, for example, Eastman AQ polyesterionomers, manufactured by Eastman Chemical Co.

The nonionic dicarboxylic acid repeat units are provided by dicarboxylic acids or their functional equivalents represented by the formula:

$$-\overset{O}{\overset{\|}{C}}-R-\overset{O}{\overset{\|}{C}}-$$

where R is an aromatic or aliphatic hydrocarbon or contains both aromatic and aliphatic hydrocarbons. Exemplary compounds include isophthalic acid, terephthalic acid, 2,5-,2,6- or 2,7-naphthalene dicarboxylic acid, succinic acid, sebacic acid, adipic acid, azelaic acid, diphenyl dicarboxylic acid, cyclohexylene dicarboxylic acid and the like.

Suitable diols are represented by the formula HO—R—OH, where R is aromatic or aliphatic or contains both aromatic and aliphatic hydrocarbons. Suitable diols include ethylene glycol, diethylene, glycol, 1,4-cyclohexanedimethanol, 1,3-propanol diol, 1,4-butane diol, neopenty glycol, and the like.

Solvents useful for preparing coatings of carbon nanofibers include: water, alcohols such as methanol, ethanol, propanol, isopropanol; ketones such as acetone, methylethyl ketone, and methylisobutyl ketone; esters such as methyl acetate and ethyl acetate; glycol ethers such as methyl cellusolve, ethyl cellusolve; and mixtures thereof. It is a particular advantage of this invention that excellent electrically-conductive layers can be formed from aqueous dispersions, thereby avoiding the need to use organic solvents.

In addition to binders and solvents, other components that are well known in the photographic art may also be present in the electrically-conductive layer. These additional components include: surfactants and coating aids, thickeners, dispersants, crosslinking agents or hardeners, soluble and/or solid particle dyes, antifoggants, matte beads, lubricants, and others.

In the practice of this invention, dispersions of carbon nanofibers formulated with binder and additives can be coated onto a variety of photographic supports. Suitable film supports include polyethylene terephthalate, polyethylene naphthalate, polycarbonate, polystyrene, cellulose nitrate, cellulose acetate, cellulose acetate butyrate, cellulose acetate propionate, and laminates thereof. Film supports can be either transparent or opaque depending on the application. Transparent film supports can be either colorless or colored by the addition of a dye or pigment. Film supports can be surface treated by various processes including corona discharge, glow discharge, UV exposure, solvent washing or overcoated with polymers such as vinylidene chloride containing copolymers, butadiene-based copolymers, glycidyl acrylate or methacrylate containing copolymers, or maleic anhydride containing copolymers. Suitable paper supports include polyethylene-, polypropylene-, and ethylene-butylene copolymer-coated or laminated paper and synthetic papers.

The formulated dispersions can be applied to the aforementioned film or paper supports by any of a variety of well-known coating methods. Handcoating techniques include using a coating rod or knife or a doctor blade. Machine coating methods include skim pan/air knife coating, roller coating, gravure coating, curtain coating, bead coating or slide coating.

The antistatic layer or layers containing the carbon nanofibers can be applied to the support in various configurations depending upon the requirements of the specific application. In the case of photographic elements for graphics arts application, an antistatic layer can be applied to a polyester film base during the support manufacturing process after orientation of the cast resin on top of a polymeric undercoat layer. The antistatic layer can be applied as a subbing layer under the sensitized emulsion, on the side of the support opposite the emulsion or on both sides of the support. When the antistatic layer is applied as a subbing layer under the sensitized emulsion, it is not necessary to apply any intermediate layers such as barrier layers or adhesion promoting layers between it and the sensitized emulsion, although they can optionally be present. Alternatively, the antistatic layer can be applied as part of a multi-component curl control layer on the side of the support opposite to the sensitized emulsion. The antistatic layer would typically be located closest to the support. An intermediate layer, containing primarily binder and antihalation dyes functions as an antihalation layer. The outermost layer containing binder, matte, and surfactants functions as a protective overcoat. Other addenda, such as polymer lattices to improve dimensional stability, hardeners or crosslinking agents, and various other conventional additives can be present optionally in any or all of the layers.

In the case of photographic elements for direct or indirect x-ray applications, the antistatic layer can be applied as a subbing layer on either side or both sides of the film support. In one type of photographic element, the antistatic subbing layer is applied to only one side of the film support and the sensitized emulsion coated on both sides of the film support. Another type of photographic element contains a sensitized emulsion on only one side of the support and a pelloid containing gelatin on the opposite side of the support. An antistatic layer can be applied under the sensitized emulsion or, preferably, the pelloid. Additional optional layers can be present. In another photographic element for x-ray applications, an antistatic subbing layer can be applied either under or over a gelatin subbing layer containing an antihalation dye or pigment. Alternatively, both antihalation and antistatic functions can be combined in a single layer containing conductive particles, antihalation dye, and a binder. This hybrid layer can be coated on one side of a film support under the sensitized emulsion.

The conductive layer of this invention may also be used as the outermost layer of an imaging element, for example, as the protective overcoat that overlies a photographic emulsion layer. Alternatively, the conductive layer can function as an abrasion-resistant backing layer applied on the side of the film support opposite to the imaging layer.

It is also contemplated that the electrically-conductive layer described herein can be used in imaging elements in which a relatively transparent layer containing magnetic particles dispersed in a binder is included. The electrically-conductive layer of this invention functions well in such a combination and gives excellent photographic results. Transparent magnetic layers are well known and are described, for example, in U.S. Pat. No. 4,990,276, European Patent 459,349, and *Research Disclosure*, Item 34390, November, 1992, the disclosures of which are incorporated herein by reference. As disclosed in these publications, the magnetic particles can be of any type available such as ferro- and ferri-magnetic oxides, complex oxides with other metals, ferrites, etc. and can assume known particulate shapes and sizes, may contain dopants, and may exhibit the pH values known in the art. The particles may be shell coated and may be applied over the range of typical laydown.

Imaging elements incorporating conductive layers of this invention that are useful for other specific applications such as color negative films, color reversal films, black-and-white films, color and black-and-white papers, electrophotographic media, thermal dye transfer recording media etc., can also be prepared by the procedures described hereinabove.

The invention is further illustrated by the following examples of its practice. In these examples, the surface resistivity (SER) was measured with the use of a two-point probe method as described in U.S. Pat. No. 2,801,191 and is reported in log ohms per square. Densities in the visible and ultraviolet region were determined with the use of a densitometer.

EXAMPLES 1–13

Antistatic coatings were prepared from aqueous dispersions of carbon nanofibers in various film-forming binders.

The carbon nanofibers utilized were PYROGRAF III carbon nanofibers, having a nominal diameter of 200 nanometers, obtained from Applied Sciences, Inc., Cedarville, Ohio. In addition to the carbon nanofibers and film-forming binder, the coating composition contained the dispersant TAMOL SN, an anionic disulfonate naphthalene condensation product available from ROHM & HAAS CORPORATION and the surfactant TRITON TX-100 a nonionic octyl phenoxy polyethylene oxide available from ROHM & HAAS CORPORATION.

Figure 4:
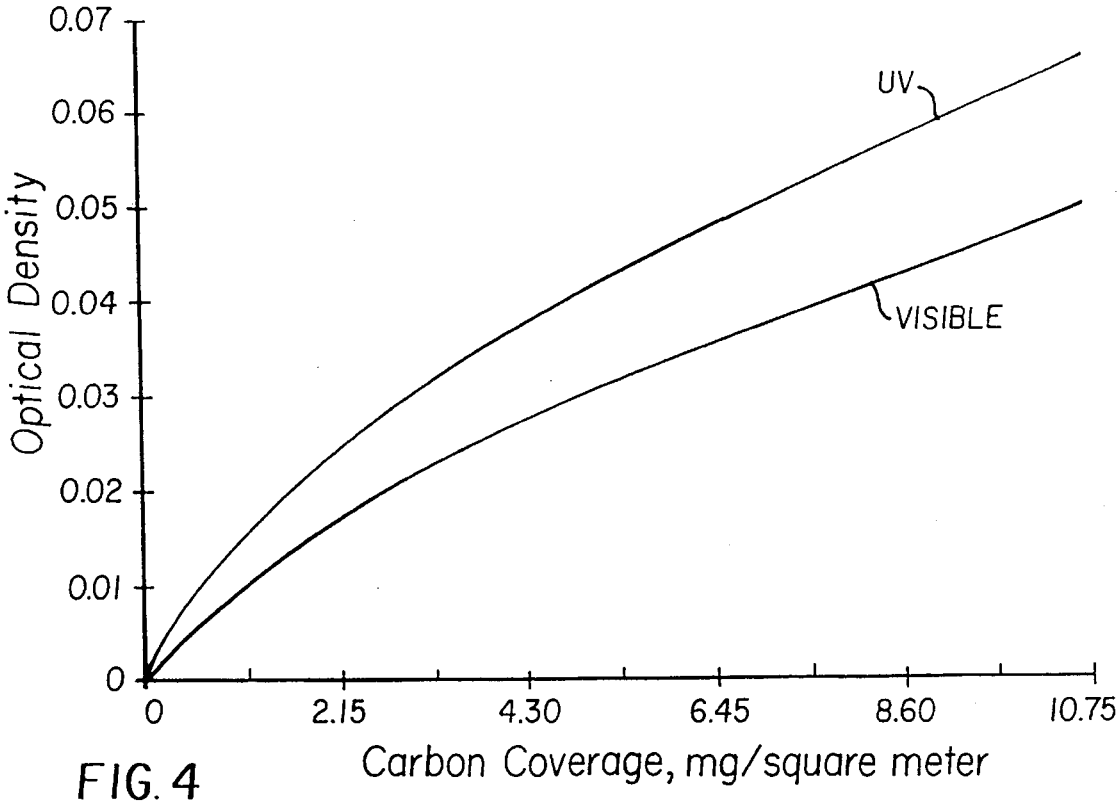
FIG. 4 is a plot on an expanded scale of optical density versus carbon coverage for the low coverage region of FIG. 3.
Figure 5:
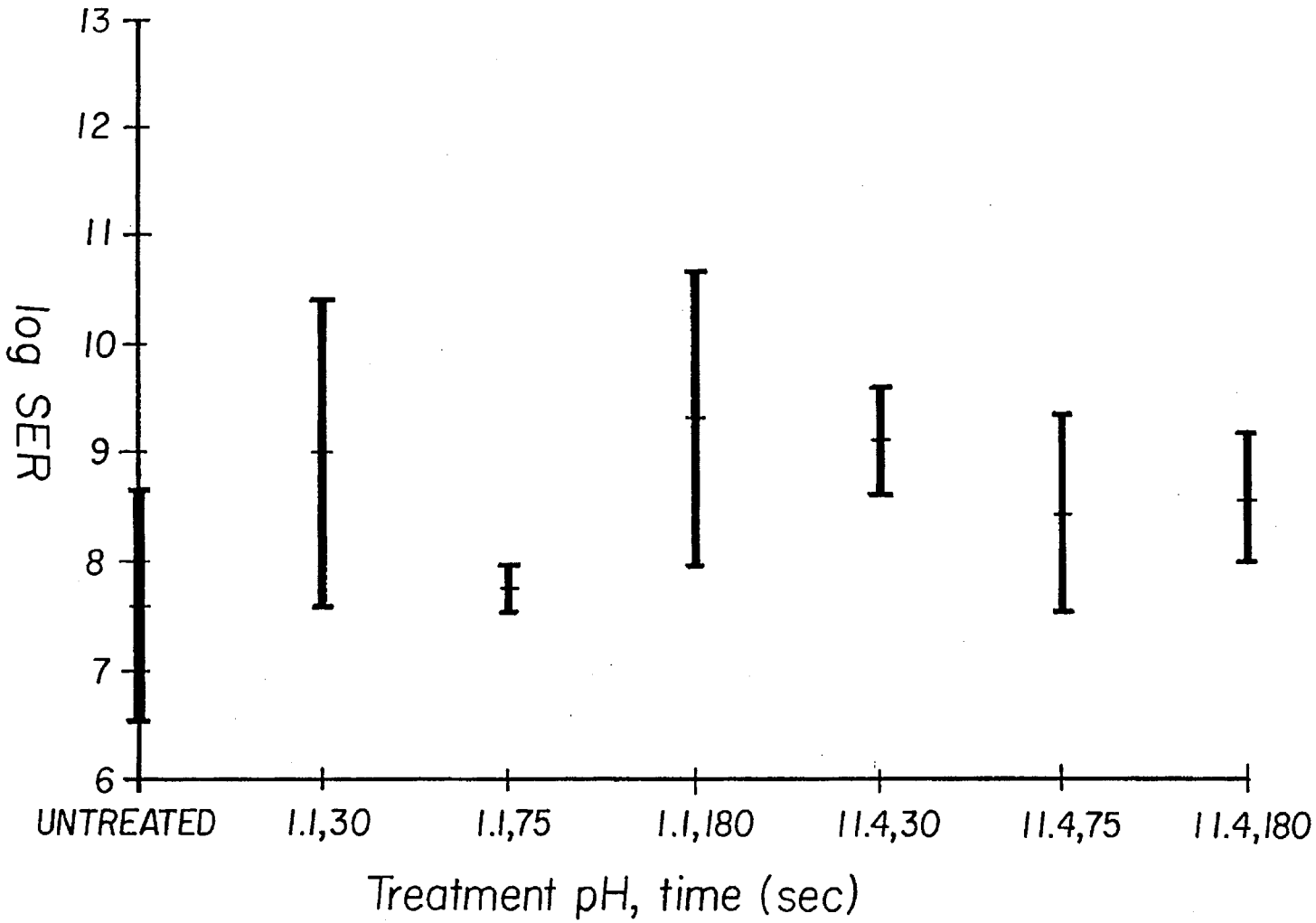
FIG. 5 is a plot of surface resistivity in relation to time and pH of extreme pH treatments for electrically-conductive layers containing carbon nanofibers.

The film-forming binders employed and the amount of binder, carbon nanofibers, dispersant and surfactant utilized are summarized in Table I below. The carbon coverage, log SER and optical density are summarized in Table II below. Surface resistivity (SER) is determined under ambient conditions, under 20% relative humidity conditions and following treatment with the processing baths employed in the KODAK C-41 color negative process. Optical density measurements are reported with respect to both ultraviolet density and visible density.

bers with nominal diameters of 100 nanometers and 50 nanometers. In FIG. 2, the relationship between surface resistivity and carbon coverage has been shown on an expanded scale to more clearly demonstrate the results achievable with carbon nanofibers with a nominal diameter of only 50 nanometers. FIG. 3 is a plot of the optical density data reported in Table II and illustrates the effect of carbon coverage on optical density both as measured in the ultraviolet and in the visible. FIG. 4 is a plot of optical density versus carbon coverage which has been presented on an expanded scale to more clearly illustrate the results achievable by the use of very low coverages. FIG. 5 represents the range of surface resistivity values measured when the electrically-conductive layer was subjected to buffer solutions at 39° C. for the number of seconds indicated at the pH indicated, e.g., 30 seconds at pH 1.1, 75 seconds at pH 1.1, 180 seconds at pH 1.1, 30 seconds at pH 11.4, 7.5 seconds at pH 11.4 and 180 seconds at pH 11.4. These values represent the most extreme values encountered in photographic processing and demonstrate the excellent process-surviving capabilities of the electrically-conductive layer.

TABLE I

| | Example No. | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Carbon nanofibers (wt %) | 0.49 | 0.49 | 0.49 | 0.10 | 0.20 | 0.20 | 0.10 | 0.10 | 0.10 | 0.10 | 0.10 | 0.10 | 0.10 |
| Binder (wt %) | | | | | | | | | | | | | |
| TMOS[1] (as $SiO_2$) | 0.25 | | | | | | | | | | | | |
| WITCOBOND W-160[2] | | 0.25 | 0.51 | 0.05 | 0.19 | 0.11 | 0.10 | 0.10 | | | | | |
| WITCOBOND W-232[3] | | | | | | | | | | | | | 0.20 |
| AQ-55[4] | | | | 0.05 | 0.10 | 0.19 | | | 0.10 | | | | |
| Hd latex[5] | | | | | | | | | | 0.22 | | | |
| S latex[6] | | | | | | | | | | | 0.23 | 0.23 | |
| Dispersant (wt %) | 0.194 | 0.196 | 0.194 | 0.010 | 0.020 | 0.020 | 0.051 | 0.099 | 0.102 | 0.052 | 0.052 | 0.052 | 0.053 |
| Surfactant (wt %) | 0.025 | 0.025 | 0.025 | 0.024 | 0.025 | 0.025 | 0.027 | 0.026 | 0.027 | 0.024 | 0.024 | 0.024 | 0.024 |

[1]Partially polymerized tetramethyl orthosilicate
[2]WITCOBOND W-160 is a water-based polyurethane resin available from WITCO CORPORATION
[3]WITCOBOND W-232 is a water-based polyurethane resin available from WITCO CORPORATION
[4]AQ-55 is a polyester (glycolate) ionomer based on sodium sulfo-isophthalate and -terephthalate available from EASTMAN CHEMICALS COMPANY
[5]Hd latex is a vinylidene chloride/acrylonitrile/acrylic acid terpolymer
[6]S latex is a vinylidene chloride/methyl acrylate/itaconic acid terpolymer

TABLE II

| | Example No. | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Carbon average ($mg/m^2$) | 269 | 269 | 269 | 36.6 | 73.2 | 73.2 | 36.6 | 54.8 | 54.8 | 54.8 | 36.6 | 54.8 | 54.8 |
| log SER | | | | | | | | | | | | | |
| ambient | 4.1 | 4.0 | 4.2 | 7.6 | 5.2 | 5.3 | 7.4 | 6.1 | 6.2 | 5.6 | 6.2 | 5.9 | 6.3 |
| 20% RH | | | | 6.6 | 5.1 | 5.9 | | | | | | | |
| post C-41 process | | | | | | | 8.1 | 6.6 | 7.3 | 6.0 | 7.6 | 6.8 | 9.0 |
| Optical Density | | | | | | | | | | | | | |
| Ultraviolet | — | 0.48 | 0.47 | 0.13 | 0.22 | 0.21 | 0.13 | 0.17 | 0.18 | 0.16 | 0.14 | 0.16 | 0.22 |
| Visible | — | 0.44 | 0.43 | 0.11 | 0.19 | 0.18 | 0.12 | 0.15 | 0.16 | 0.14 | 0.12 | 0.13 | 0.15 |

The surface resistivity values reported in Table II are plotted in FIG. 1 which is a plot of the SER value in log ohms per square versus the carbon coverage in milligrams per square meter. FIG. 1 also includes curves, derived by calculation from the experimental data, for carbon nanofi- As hereinabove described, the use of carbon nanofibers to provide electrically-conductive layers in imaging elements overcomes many of the difficulties that have heretofore been encountered in the art. In particular, the use of carbon nanofibers together with a suitable binder enables the preparation of electrically-conductive layers which are useful in a wide variety of imaging elements, which can be manufactured at reasonable cost, which are resistant to the effects of humidity change, which are durable and abrasion-resistant, which are effective at low coverage, which are adaptable to use with transparent imaging elements, which do not exhibit adverse sensitometric or photographic effects, and which are substantially insoluble in solutions with which the imaging element typically comes in contact.

The invention has been described in detail, with particular reference to certain preferred embodiments thereof, but it should be understood that variations and modifications can be effected within the spirit and scope of the invention.

I claim:

1. An imaging element for use in an image-forming process; said imaging element comprising a support, an image-forming layer, and an electrically-conductive layer; said electrically-conductive layer comprising a dispersion of carbon nanofibers in a film-forming binder.

2. An imaging element as claimed in claim 1, wherein the weight ratio of carbon nanofibers to film-forming binder is in the range of 0.01 to 1 to 100 to 1.

3. An imaging element as claimed in claim 1, wherein the weight ratio of carbon nanofibers to film-forming binder is in the range of 0.1 to 1 to 10 to 1.

4. An imaging element as claimed in claim 1, wherein the weight ratio of carbon nanofibers to film-forming binder is in the range of 0.5 to 2 to 2 to 1.

5. An imaging element as claimed in claim 1, wherein said carbon nanofibers have a diameter of less than 500 nanometers.

6. An imaging element as claimed in claim 1, wherein said carbon nanofibers have a diameter of less than 200 nanometers.

7. An imaging element as claimed in claim 1, wherein said carbon nanofibers have a diameter of less than 50 nanometers.

8. An imaging element as claimed in claim 1, wherein said carbon nanofibers have a length to diameter ratio of at least 20.

9. An imaging element as claimed in claim 1, wherein said carbon nanofibers have a length to diameter ratio of at least 50.

10. An imaging element as claimed in claim 1, wherein said carbon nanofibers have a powder resistivity of less than one ohm-cm.

11. An imaging element as claimed in claim 1, wherein the coverage of said carbon nanofibers, based on weight of carbon, is from 1 to 300 $mg/m^2$.

12. An imaging element as claimed in claim 1, wherein the coverage of said carbon nanofibers, based on weight of carbon, is from 2 to 50 $mg/m^2$.

13. An imaging element as claimed in claim 1, wherein said binder is a water-soluble polymer.

14. An imaging element as claimed in claim 1, wherein said binder is gelatin.

15. An imaging element as claimed in claim 1, wherein said binder is a polyalkoxysilane.

16. An imaging element as claimed in claim 1, wherein said binder is a polyesterionomer.

17. An imaging element as claimed in claim 1, wherein said binder is a polyurethane resin.

18. An imaging element as claimed in claim 1, wherein said support is a poly(ethylene terephthalate) film or a poly(ethylene naphthalate) film.

19. An imaging element as claimed in claim 1, wherein said support is a transparent polymeric film, said image-forming layer is comprised of silver halide grains dispersed in gelatin, and said film-forming binder in said electrically-conductive layer is gelatin.

20. An imaging element as claimed in claim 1, wherein said element is a photographic film.

21. An imaging element as claimed in claim 1, wherein said element is a photographic paper.

22. An imaging element as claimed in claim 1, wherein said element is an electrostatographic element.

23. An imaging element as claimed in claim 1, wherein said element is a photothermographic element.

24. An imaging element as claimed in claim 1, wherein said element is an element adapted for use in a laser toner fusion process.

25. An imaging element as claimed in claim 1, wherein said element is a thermal-dye-transfer receiver element.

26. An imaging element for use in an image-forming process; said imaging element comprising a support, an image-forming layer, a transparent magnetic layer comprising magnetic particles dispersed in a film-forming binder, and an electrically-conductive layer comprising a dispersion of carbon nanofibers in a film-forming binder.

27. A photographic film comprising:

(1) a support;

(2) an electrically-conductive layer which serves as an antistatic layer overlying said support; and (3) a silver halide emulsion layer overlying said electrically-conductive layer; said electrically-conductive layer comprising a dispersion of carbon nanofibers in a film-forming binder.

28. A photographic film comprising:

(1) a support;

(2) a silver halide emulsion layer on one side of said support;

(3) an electrically-conductive layer which serves as an antistatic layer on the opposite side of said support; and (4) a curl control layer overlying said electrically-conductive layer; said electrically-conductive layer comprising a dispersion of carbon nanofibers in a film-forming binder.

29. A photographic film comprising:

(1) a support;

(2) a silver halide emulsion layer on one side of said support; and (3) an electrically-conductive layer which serves as an antistatic backing layer on the opposite side of said support; said electrically-conductive layer comprising a dispersion of carbon nanofibers in a film-forming binder.

30. A photographic film comprising:

(1) a support;

(2) a silver halide emulsion layer on one side of said support;

(3) an electrically-conductive layer which serves as an antistatic layer on the opposite side of said support; and (4) an abrasion-resistant backing layer overlying said electrically-conductive layer; said electrically-conductive layer comprising a dispersion of carbon nanofibers in a film-forming binder.

* * * * *